US009790953B2

(12) United States Patent
Kleynhans et al.

(10) Patent No.: US 9,790,953 B2
(45) Date of Patent: Oct. 17, 2017

(54) FILTER DEVICE

(75) Inventors: George Kleynhans, Zurich (CH); Peter Ortmann, Zurich (CH); Roger Suter, Zurich (CH)

(73) Assignee: MAN Diesel & Turbo SE, Augsburg (DE)

( * ) Notice: Subject to any disclaimer, the term of this patent is extended or adjusted under 35 U.S.C. 154(b) by 797 days.

(21) Appl. No.: 12/597,110

(22) PCT Filed: Apr. 15, 2008

(86) PCT No.: PCT/EP2008/002992

§ 371 (c)(1),
(2), (4) Date: Nov. 4, 2009

(87) PCT Pub. No.: WO2008/128681

PCT Pub. Date: Oct. 30, 2008

(65) Prior Publication Data

US 2010/0135769 A1 Jun. 3, 2010

(30) Foreign Application Priority Data

Apr. 24, 2007 (DE) ..... 10 2007 019 264

(51) Int. Cl.
*F04D 29/68* (2006.01)
*F04D 29/28* (2006.01)
(Continued)

(52) U.S. Cl.
CPC ..... *F04D 29/284* (2013.01); *F04D 29/162* (2013.01); *F04D 29/701* (2013.01); *F04D 31/00* (2013.01); *F04D 27/0215* (2013.01)

(58) Field of Classification Search
CPC ..... F04D 29/682; F04D 29/685
(Continued)

(56) References Cited

U.S. PATENT DOCUMENTS 3,217,655 A * 11/1965 Sercy et al. ..... 415/116
RE26,570 E * 4/1969 Dunn ..... F04D 13/0653 184/109

(Continued)

FOREIGN PATENT DOCUMENTS

DE 1026916 * 3/1958 ..... F02C 3/05
DE 19 71 303 10/1967

(Continued)

OTHER PUBLICATIONS

English translation of Japanese Office Action dated May 15, 2012, issued in corresponding application No. 2010-504498.

(Continued)

*Primary Examiner* — Sean J Younger
(74) *Attorney, Agent, or Firm* — Cozen O'Connor

(57) ABSTRACT

A multi or single-stage turbocompressor with at least one compressor wheel fastened to a shaft. The shaft is mounted in a turbocompressor housing which, behind the hub disc of the compressor wheel, includes an interior housing region as well as in front of the hub disc of the compressor wheel a front interior housing region. The driven compressor wheel delivers a fluid from an inlet channel to an outlet channel. The front interior housing region includes a wheel lateral space from which an extraction channel for the extraction of fluid is provided.

10 Claims, 3 Drawing Sheets

(51) Int. Cl.

| | |
|---|---|
| ***F04D 29/70*** | (2006.01) |
| ***F04D 31/00*** | (2006.01) |
| ***F04D 29/16*** | (2006.01) |
| *F04D 27/02* | (2006.01) |

(58) Field of Classification Search
USPC ..... 415/56.4, 56.5, 57.3, 57.4, 58.4, 58.6, 415/121.2, 206
See application file for complete search history.

(56) References Cited

U.S. PATENT DOCUMENTS

| | | | | |
|---|---|---|---|---|
| 3,462,071 | A * | 8/1969 | Garve | F02B 33/00 123/559.1 |
| 4,689,960 | A * | 9/1987 | Schroder | F02B 37/10 60/607 |
| 6,585,482 | B1 * | 7/2003 | Liotta et al. | 415/116 |
| 6,699,008 | B2 * | 3/2004 | Japikse | 415/58.4 |
| 2006/0045764 | A1 * | 3/2006 | Thompson et al. | 417/313 |
| 2007/0172363 | A1 * | 7/2007 | Laboube et al. | 417/370 |
| 2007/0217902 | A1 * | 9/2007 | Sirakov et al. | 415/58.4 |

FOREIGN PATENT DOCUMENTS

| | | | | |
|---|---|---|---|---|
| EP | 0795689 | | 9/1997 | |
| GB | 2307276 | | 5/1997 | |
| JP | 61-25600 | | 2/1986 | |
| JP | 03260336 | A * | 11/1991 | F02C 3/05 |
| JP | 2000-230493 | | 8/2000 | |

OTHER PUBLICATIONS

English translation of International Preliminary Report on Patentability dated Oct. 27, 2009, issued in corresponding application No. PCT/EP2008/002992.

Boddenberg, K. "On the Manufacture of Impellers for Turbo Compressors". Proc. of 15$^{th}$ Turbo Machinery Symposium, Texas University 1996.

* cited by examiner

FILTER DEVICE

PRIORITY CLAIM

This is a U.S. national stage of application No. PCT/EP2008/002992, filed on Apr. 15, 2008, which claims Priority to the German Application No.: 10 2007 019 264.0, Filed: Apr. 24, 2007, for the contents of both applications being incorporated herein by reference.

BACKGROUND OF THE INVENTION

1. Field of the Invention

The present invention relates to a separating device for a fluid in turbocompressors. More preferably the invention relates to a radial compressor with a separating device to clean a flow of process gas of particles and droplets so that a supply of said flow can be used as clean gas.

2. Prior Art

The extraction of clean gas from a compressed process gas is known from the prior art, especially when it concerns gases in the field of the oil and gas industry. The process gas comprises contaminants such as particles and liquids. These contaminants are removed from the process gas via maintenance-intensive filters before the treated process gas is supplied for further use (e.g. as sealing gas for dry gas seals or as cooling gas).

SUMMARY OF THE INVENTION

An object of the present invention is an improved system for extracting clean gas. The object is solved using a turbocompressor The turbocompressor according to one embodiment of the invention, which is preferably designed as a radial turbocompressor, comprises at least one shaft to which at least one compressor wheel is fastened. The driven compressor wheel delivers a fluid such as natural gas or crude gas contaminated with particles and/or liquids from an inlet channel to an outlet channel. The fluid is accelerated by the compressor wheel in a radial direction. The particles contained in the fluid are accelerated such that they are delivered in an outlet cross section of the running wheel along a rear housing region, i.e. towards a hub disc. For this reason, gas with reduced particle/liquid load will flow into the wheel lateral space. In a front housing region, i.e. in a region of a cover disc, a wheel lateral space is formed. Wheel lateral spaces are the gap spaces between compressor wheel and housing. From the wheel lateral space in the region of the cover disc a discharge channel is provided in the front housing region which serves to remove the cleaned fluid.

Based on one embodiment of the invention, a maintenance-free filtering device for extracting clean gas can thus be realised. The invention can also be used as a pre-cleaning stage to extend service intervals of conventional filtering devices.

BRIEF DESCRIPTION OF THE DRAWINGS

The present invention is explained in more detail in the following by means of drawings. It shows.

DETAILED DESCRIPTION OF THE DRAWINGS

Figure 1:
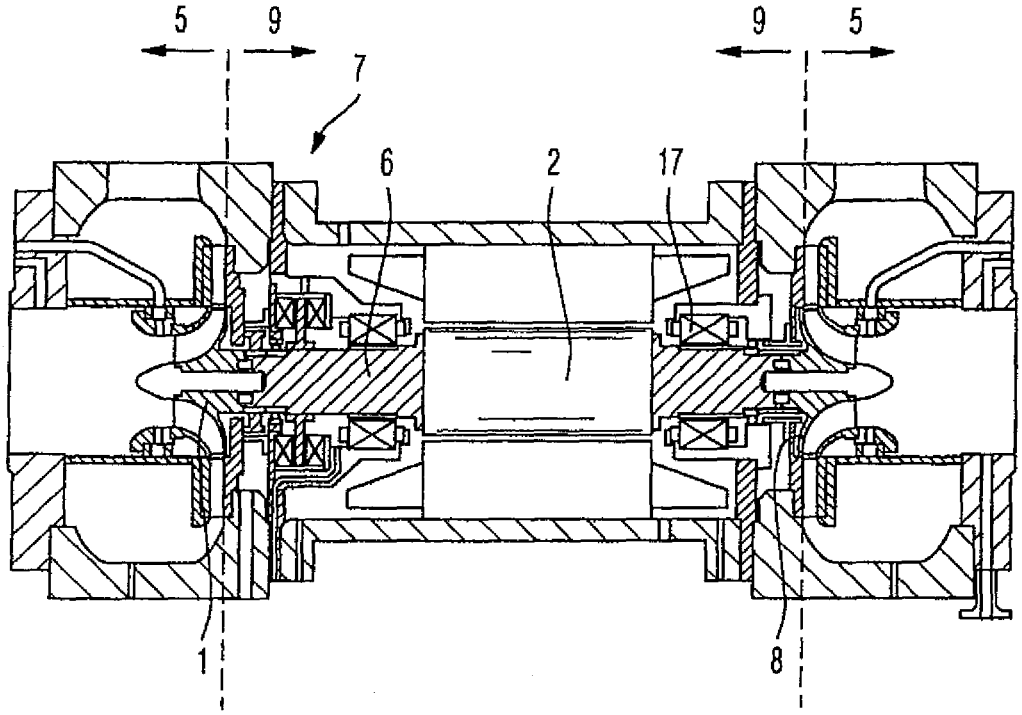
FIG. 1 is a schematic cross-sectional view of a compressor.

FIG. 1 is a basic construction of a radial compressor with two compressor stages driven via an electric motor 2 for use on pipelines. The shaft 6 of the compressor is mounted through magnetic bearings 17. The region in front of each compressor wheel is designated as front housing region 5. The region behind each compressor wheel 1, i.e. behind the hub disc 8 of the compressor wheel 1 is designated as rear housing region 9. The vertically dashed lines each form the boundary between front and rear housing region 5 and 9 respectively. The compressor as shown comprises a number of radial wheels. Dependent on the required pressure of the clean gas, the filtering device according to the invention is preferably installed in an appropriate stage, i.e. on the appropriate compressor wheel.

Figure 2:
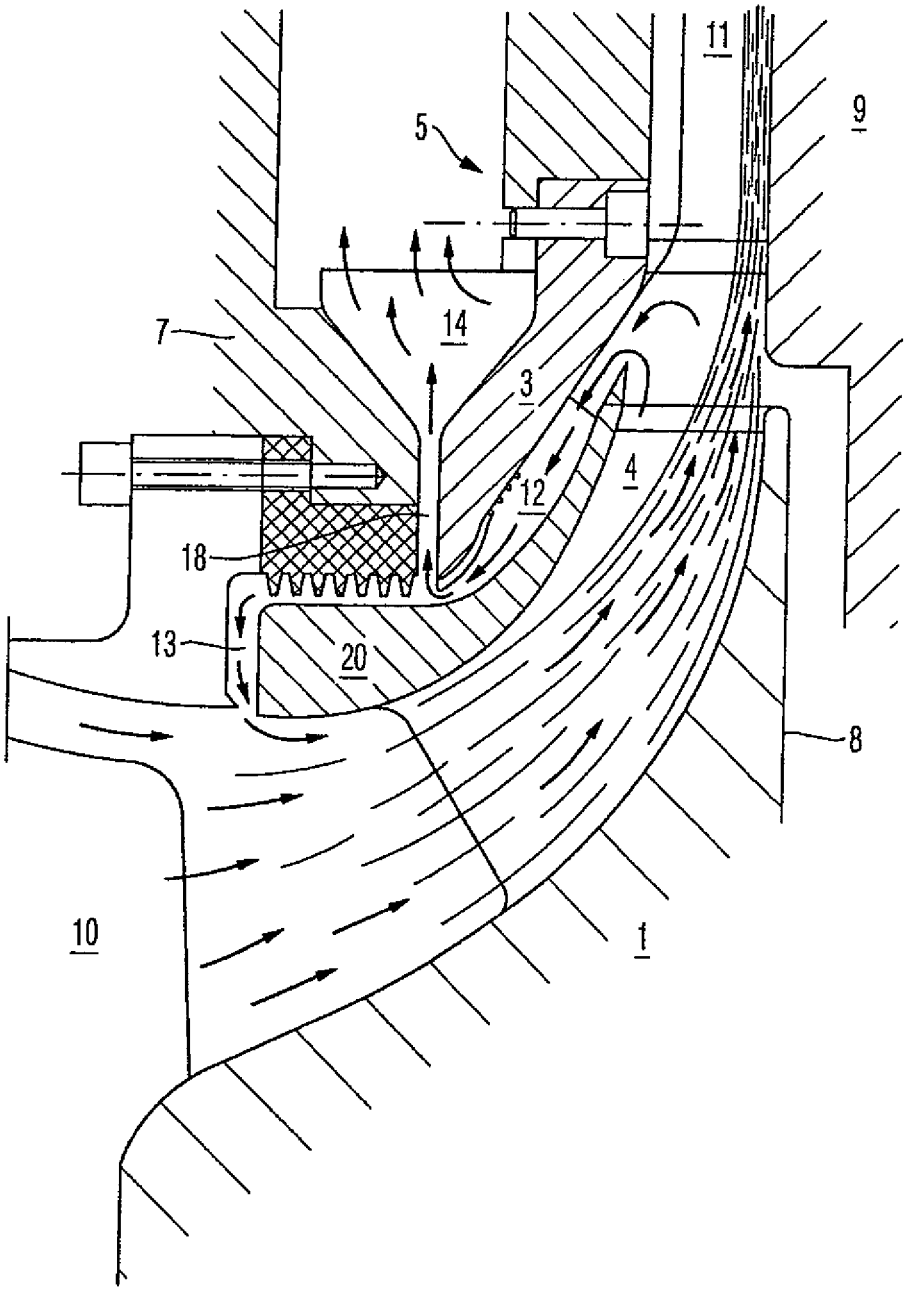
FIG. 2 is a schematic view of a compressor stage.

FIG. 2 shows an embodiment of the invention. The compressor wheel 1 is arranged on the shaft 6, which is driven by a machine, for example an electric motor 2 or a gas turbine. The stage shown here can be arranged in any position in the compressor. The compressor wheel 1 is surrounded by an interior housing 7, 9 which at least forms inlet channel 10 to the compressor wheel and an outlet channel 11. The outlet channel 11 is substantially perpendicular to an axis of rotation of the compressor wheel 1 or the inlet channel 10. In FIG. 2, the front part of the interior housing 5, among other things, comprises a ring 3 which forms extraction channel 18 with a further housing part. Reference symbol 20 designates the cover disc of the compressor wheel 1. The arrows between inlet and outlet channel 10, 11 depict movement directions of heavy particles in the process gas. Due to the rotation of the compressor wheel 1 and the resultant deflection of the process gas in radial direction, the heavy particles are deflected in the direction of the hub disc 8 in part by running wheel channel 4. The particles cannot follow the original gas flow. The gas flow entering the wheel lateral space 12 includes almost no contaminants. In the first embodiment the gas to be decontaminated reaches an extraction channel 18 via the wheel lateral space 12 then a collection chamber 14 and from there the further use, for example a component to be cooled. The region between extraction channel 18 or collection chamber 14 and wheel lateral space 12 or return channel 13 is designed so that particles in the respective channels are delivered back into the inlet channel 10 rather than in the extraction channel 18 and into the collection chamber 14 due to the pressure conditions.

Figure 3:
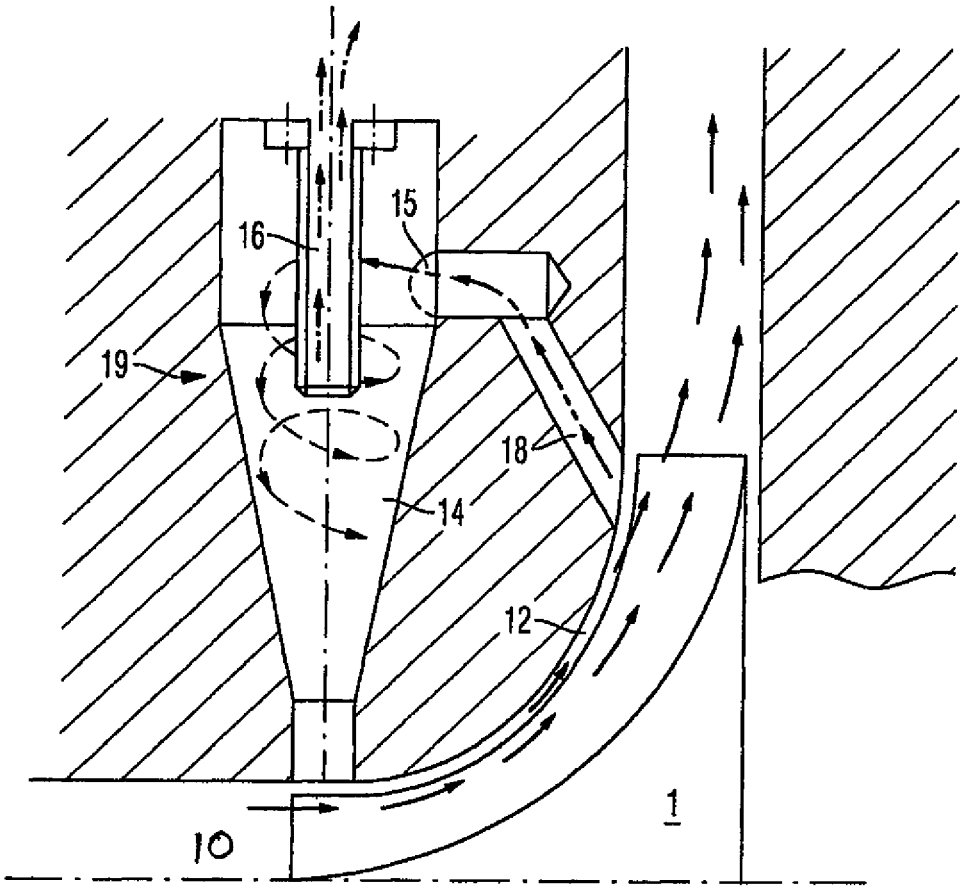
FIG. 3 is a schematic sketch of a further embodiment of the invention in cross section.

FIG. 3 shows a further embodiment of the invention. According to this embodiment, the extracted fluid from the wheel lateral space 12 reaches a centrifugal separator 19. Through a tangential or spiral-shaped inlet channel 15 the separated process gas is subjected to a swirling flow (dashed arrows). Preferably the heavier particles slide down near the outer wall of the separating chamber 14 in the direction of the inlet channel 10. Immersion tube 16 and corresponding vacuum in the immersion tube 16 extracts the largely particle-free gas from a middle of the separating chamber 14. The described channels can also be designed as a diffuser or a nozzle. In one embodiment, the collection chamber 14 and/or the extraction channel 18 is designed as a diffuser which can be provided with a profile on the inner wall. In one embodiment, the diffuser is provided with blades.

Only one compressor stage was described in each case above. Accordingly to the invention, it can also concern a multi-stage radial compressor wherein the described filtering device can be provided on only one compressor stage or on a plurality of compressor stages. In addition to this, the branched-off gas can be supplied to a drying device which can be located both in the centrifugal separator as well as in the channels towards the component to be cooled or sealed.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A turbocompressor comprising:

a housing having an inlet channel and an outlet channel;

a shaft mounted in the housing;

at least one compressor wheel having a hub disc fastened to the shaft, the hub disc dividing the housing in a flow direction into a rear interior housing region behind the hub disc and a front interior housing region front of the hub disc, the at least one compressor wheel configured to deliver a fluid from the inlet channel to the outlet channel;

a wheel lateral space, the wheel lateral space being displaced from a flow path of contaminants in the fluid between the inlet channel and the outlet channel;

an extraction channel formed in the front interior housing region and configured for the extraction of fluid directly from the wheel lateral space;

a cover disc affixed to the compressor wheel and located between the housing and the compressor wheel, wherein the wheel lateral space is positioned between the housing and the cover disc;

a running wheel channel formed between the cover disc and the compressor wheel, wherein the running wheel channel and the wheel lateral space are in fluidic communication around an end of the cover disc facing the outlet channel;

a return channel arranged in the wheel lateral space that connects the wheel lateral space to the inlet channel and that terminates in the inlet channel, wherein the wheel lateral space is in flow connection with the return channel and configured to deliver contaminants to the inlet channel due to pressure conditions; and a collection chamber coupled to the extraction channel and configured as a diffuser.

2. The turbocompressor according to claim 1 wherein the collection chamber is configured to collect particle-free fluid formed in the front interior housing region, the collection chamber arranged in flow connection with the wheel lateral space.

3. The turbocompressor according to claim 1, wherein the extraction channel is configured for flow connection with a clean gas consumer via at least one of a suitable channel, a space, and a tube.

4. The turbocompressor according to claim 1, wherein the turbocompressor is a configured as radial compressor or diagonal compressor.

5. The turbocompressor according to claim 1, wherein the turbocompressor is configured as a multi-stage single-shaft compressor.

6. The turbocompressor according to claim 1, wherein the fluid is a gas.

7. The turbocompressor according to claim 6, wherein the gas branched off via the wheel lateral space is supplied to a further treatment.

8. The turbocompressor according to claim 7, wherein the housing is gas tight to the outside and is driven by a machine.

9. The turbocompressor according to claim 8, wherein the machine is an electric motor.

10. The turbocompressor according to claim 6, wherein the gas is contaminated with at least one of particles and liquids.

* * * * *